US008302263B2

(12) United States Patent
Washington

(10) Patent No.: US 8,302,263 B2
(45) Date of Patent: Nov. 6, 2012

(54) EYE A DOOR

(76) Inventor: Charles E. Washington, New York, NY (US)

( * ) Notice: Subject to any disclaimer, the term of this patent is extended or adjusted under 35 U.S.C. 154(b) by 0 days.

(21) Appl. No.: 12/584,796

(22) Filed: Sep. 12, 2009

(65) Prior Publication Data

US 2011/0061203 A1 Mar. 17, 2011

(51) Int. Cl.
*A47B 95/04* (2006.01)

(52) U.S. Cl. ..... 16/402; 70/417; 49/460

(58) Field of Classification Search ..... 16/402, 16/250, 251; 40/331; 70/417; 49/398, 460; 150/155

See application file for complete search history.

(56) References Cited

U.S. PATENT DOCUMENTS 3,263,462 A * 8/1966 Suroff et al. ..... 70/447
7,278,284 B1 * 10/2007 James ..... 70/56

* cited by examiner

*Primary Examiner* — William L. Miller
(74) *Attorney, Agent, or Firm* — Ash Tankha; Lipton, Weinberger & Husick

(57) ABSTRACT

A rectangular partial door cover, specifically design to cover the doorknob, surface locks, deadbolt locks, and chain locks of an entrance door to an apartment or house. The base of the rectangular device is attached to the entrance door with a set of screws. The device has four sides, and a sliding door with a knob. The door slides open when the knob is pulled back, and it closes when the knob is pushed forward.

1 Claim, 9 Drawing Sheets

EYE A DOOR

FIELD OF THE INVENTION

The invention relates to a door covering, a rectangle device with a sliding door that covers: door knobs, chain locks, and deadbolts. This invention gives an aesthetic appearance to the entrance front door of a house or an apartment.

BACKGROUND OF THE INVENTION

Homes and apartments have a front entrance door, with a doorknob. In addition, they also have a variety of security devices such as: locks, chain locks and deadbolts, on the surface of the front entrance door. These devices are sometimes different in shape, sizes, and some times, have different degrees of wear and tear. All of said elements create an eyesore on the surface of the front door.

DESCRIPTION OF PRIOR ART

A search of prior art or inventions found no disclosure that specifically addresses the problems the present invention solves. Prior art patent discloses designs that are focused on decorative door covering, the examples are, U.S. Pat. No. 7,198,835 B2 Anderson, two side decorative door having one or more storage pockets. The prior art patent is made from flexible, and washable materials that covers both sides of the entire door.

Another example is U.S. Application No. 2003/0026940 to Bullock. This prior art patent is a design that covers the entire door on one side. The main function of this prior art patent is festive and holiday design decorations.

SUMMARY OF THE INVENTION

In accordance with present invention, it provides a rectangular shield, with four sides, a sliding door. The front surface of the sliding door can be decorated, painted, it can be used to post notices and reminders, and the inner body can be used to store keys. The unsightly view of door knobs, of deadbolt locks, sliding surface locks, and chain locks—with discolorations and appearances of wear and tear, from constant manipulation, creates an eyesore. The present invention conceals said door knob and other security devices.

DETAILED DESCRIPTION OF THE INVENTION

Figure 1:
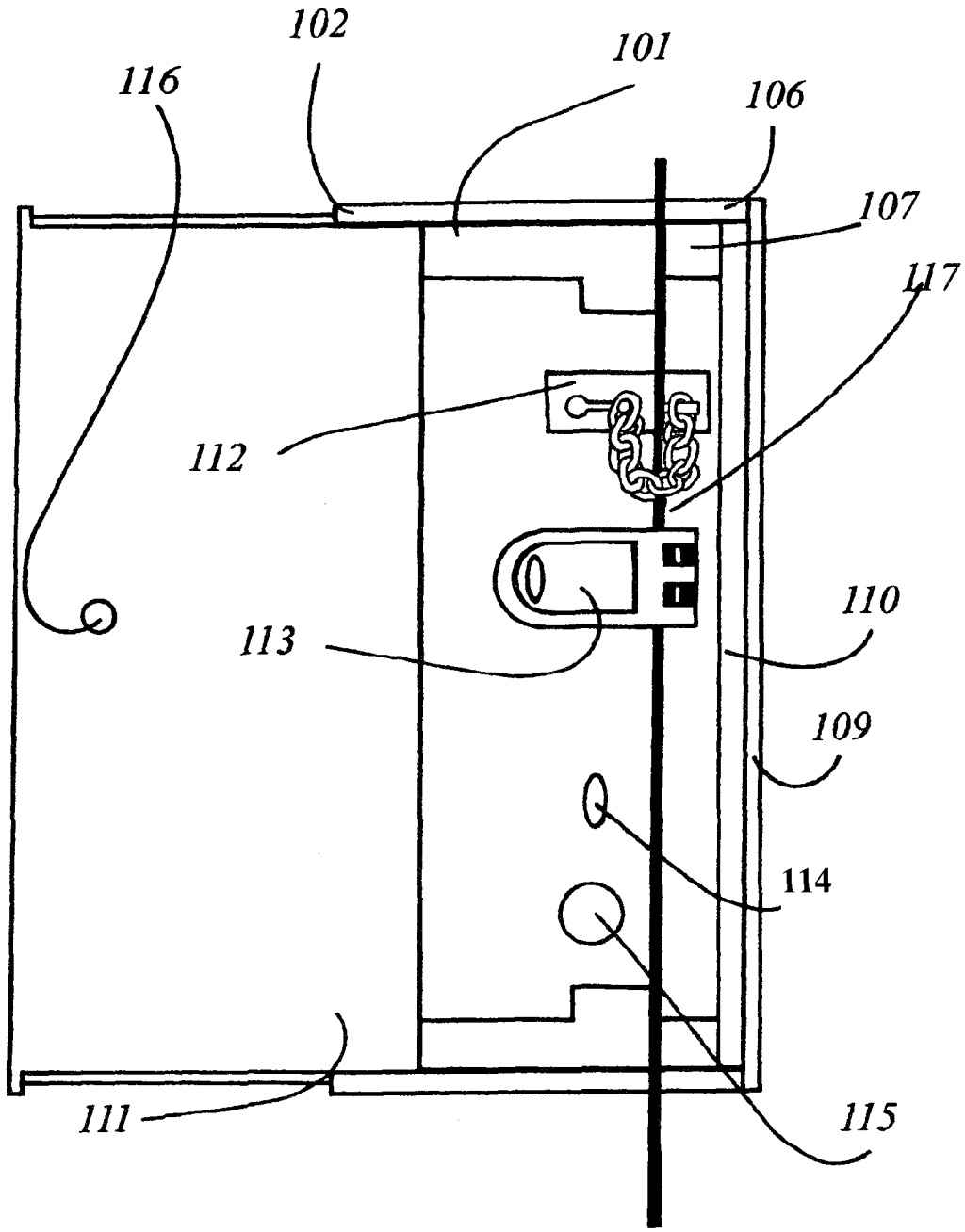
FIG. 1 is an eye level view of the present invention, the sliding door, knob attached. The apparatus is open, exposing its structure, and devices of the entrance door, such as: the entrance door knob, the deadbolt lock of said entrance door, the surface lock of said entrance door, the upper proximal and distal panels, the proximal and distal base of the apparatus with the long base, and the front panel.
Figure 2:
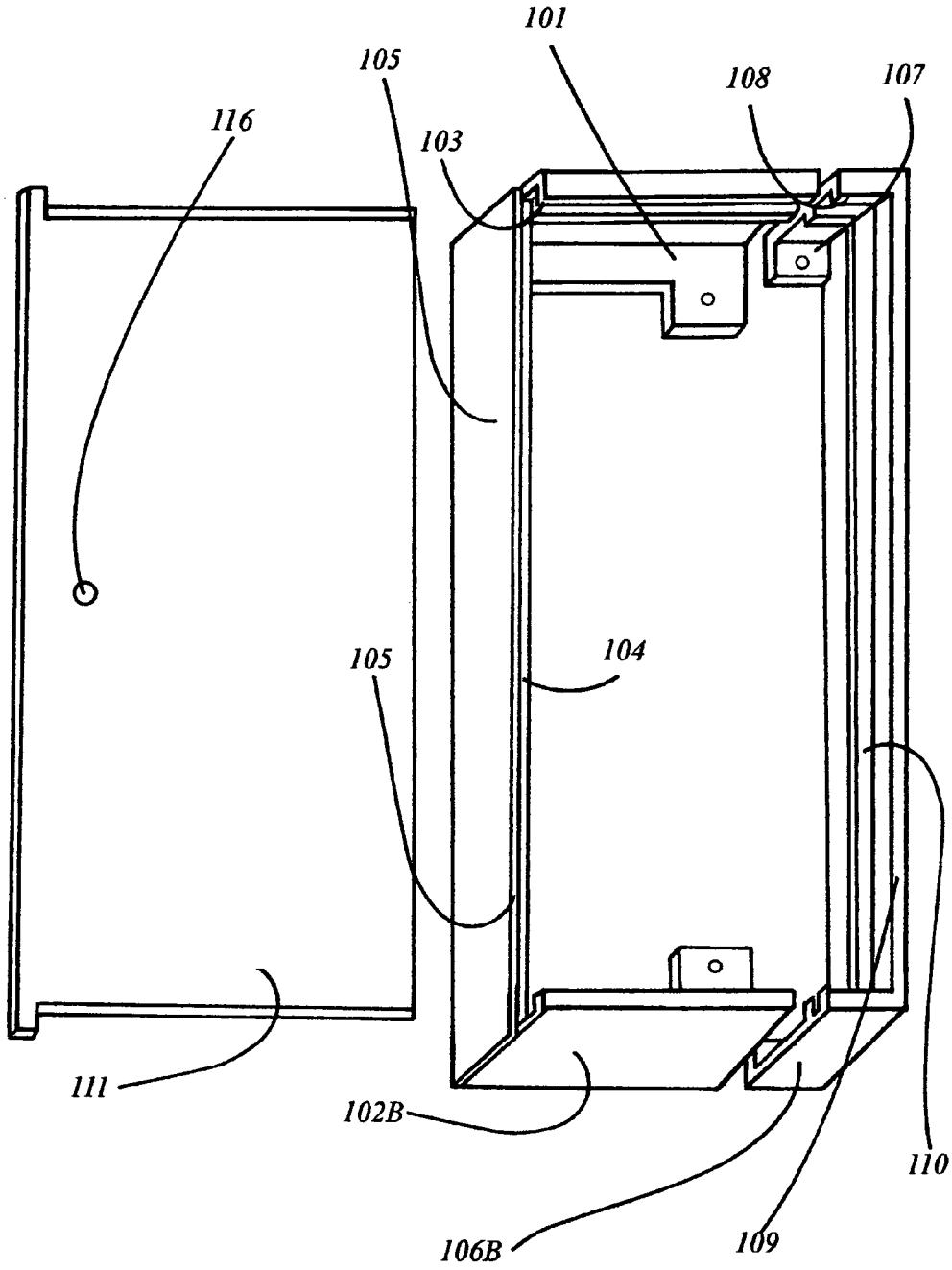
FIG. 2 is the present invention's rectangular structure with the sliding door detached from said structure with it's door knob intact, exposing the upper proximal and distal panel with the square rods attached, the rear inner and outer panels, the base of the structure with holes for screws, upper distal small panel, with small rod the long brace attached to the front panel.
Figure 3:
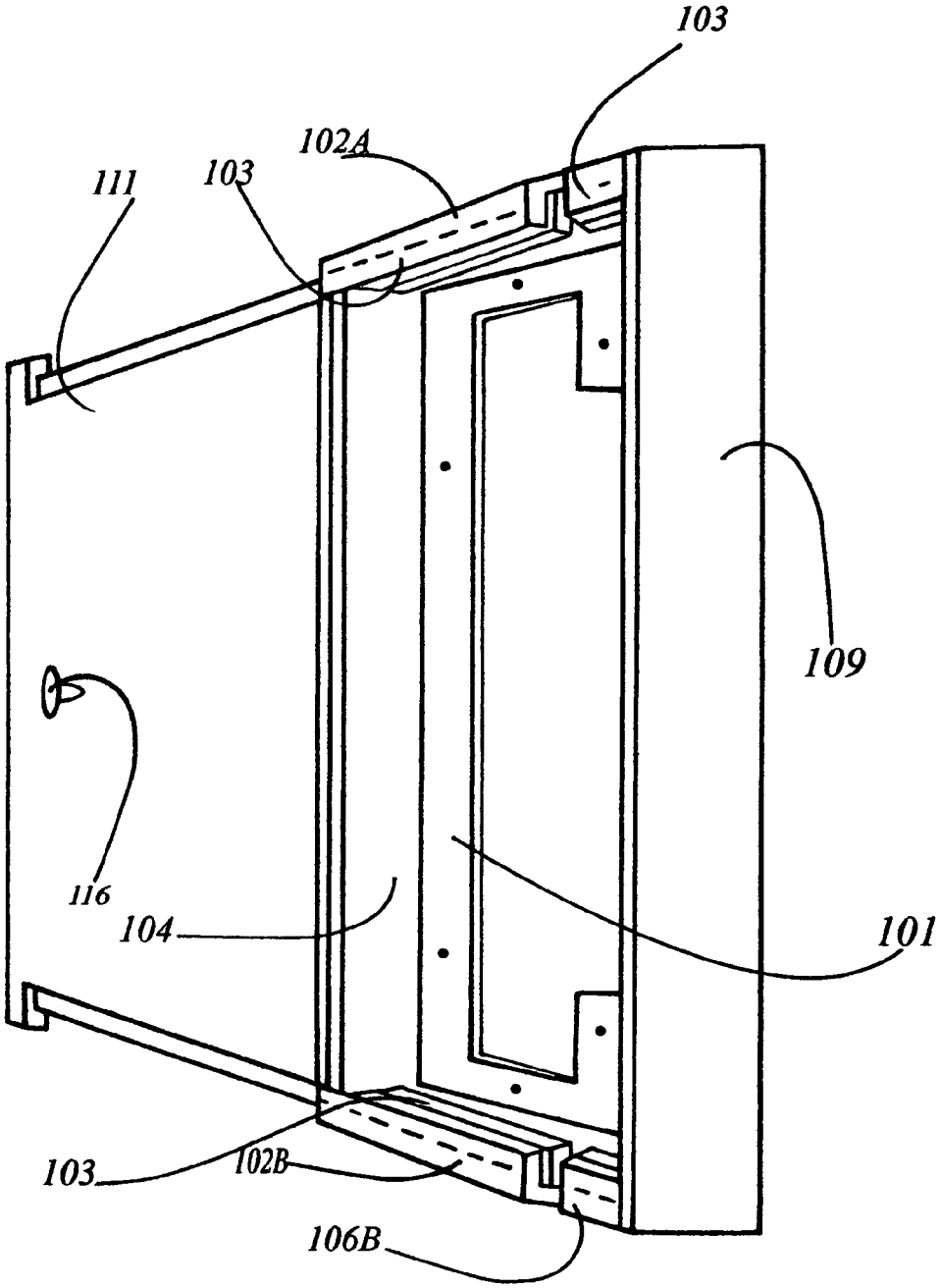
FIG. 3 is a perspective view of the present invention, the sliding door, with its knob attached at the rear opening, the inside rear panel, proximal structures, which includes the upper and lower panels the base with holes for screws, a partial view of the upper and lower distal small panels, and view of the front panel.
Figure 4:
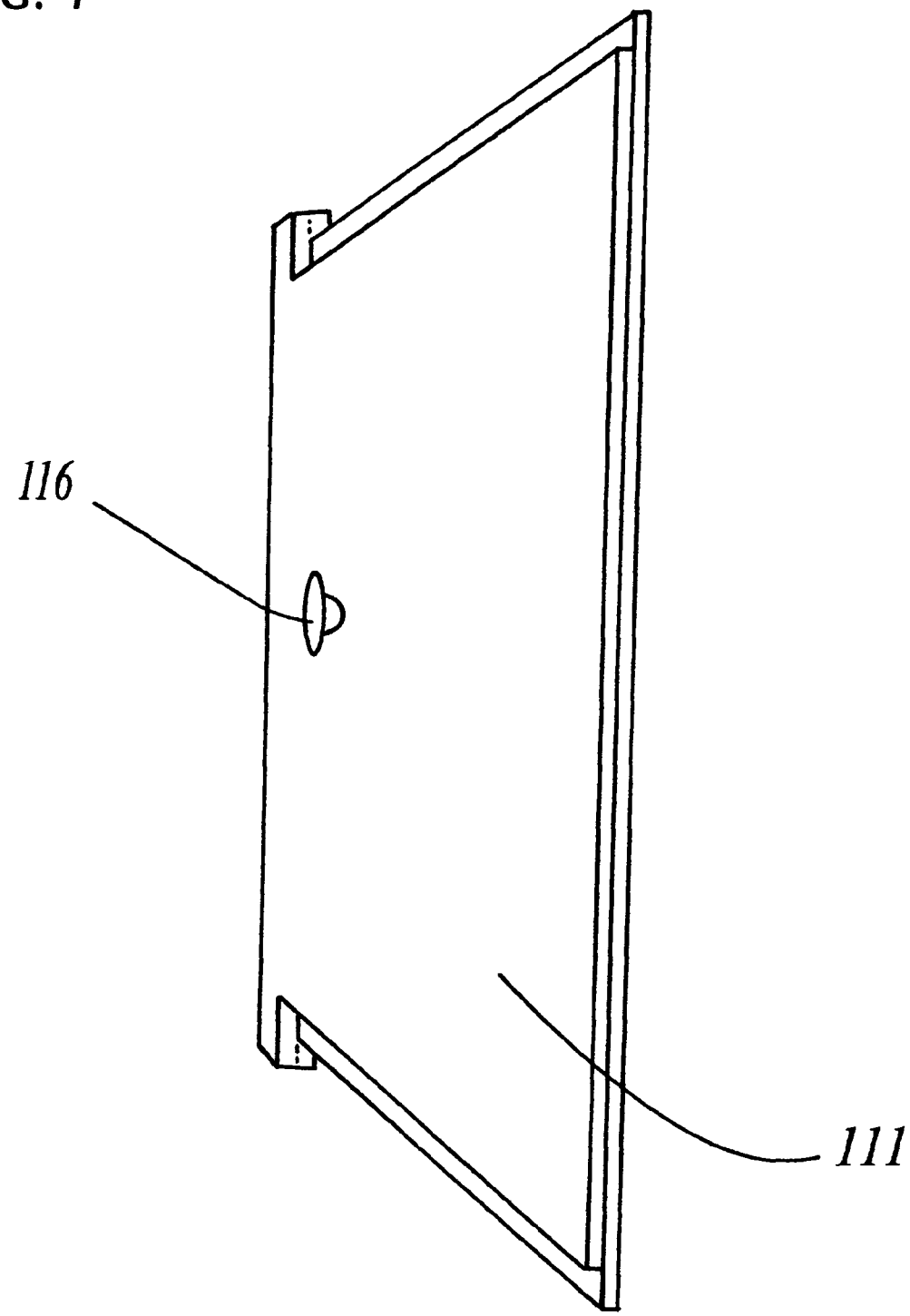
FIG. 4 is a perspective view of the sliding door, with its door knob.
Figure 5:
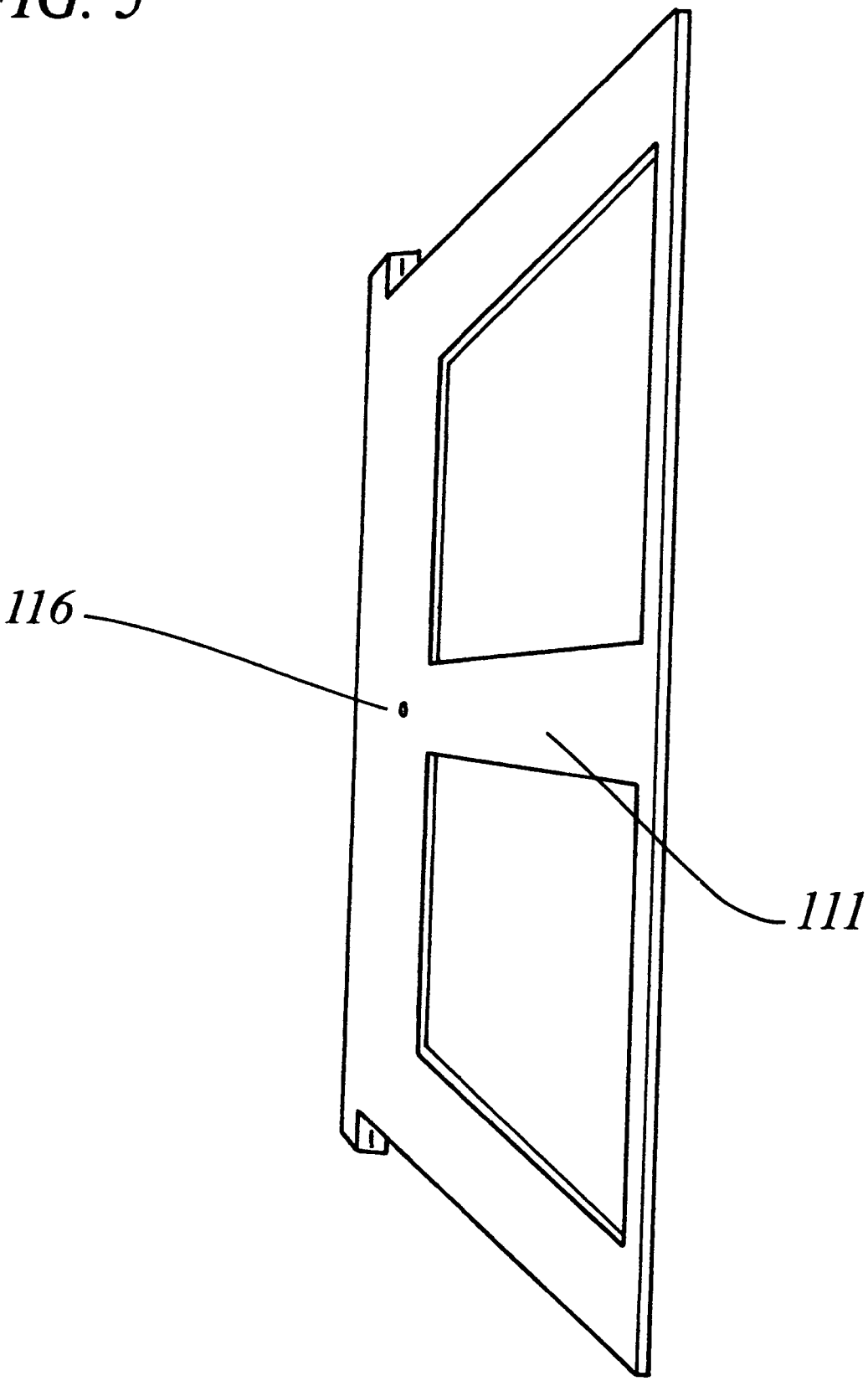
FIG. 5 is a perspective view of the sliding door's under slab, with 2 sections cut from the middle of the slab, and a hole cut, for the sliding door's knob.
Figures 6, 7:
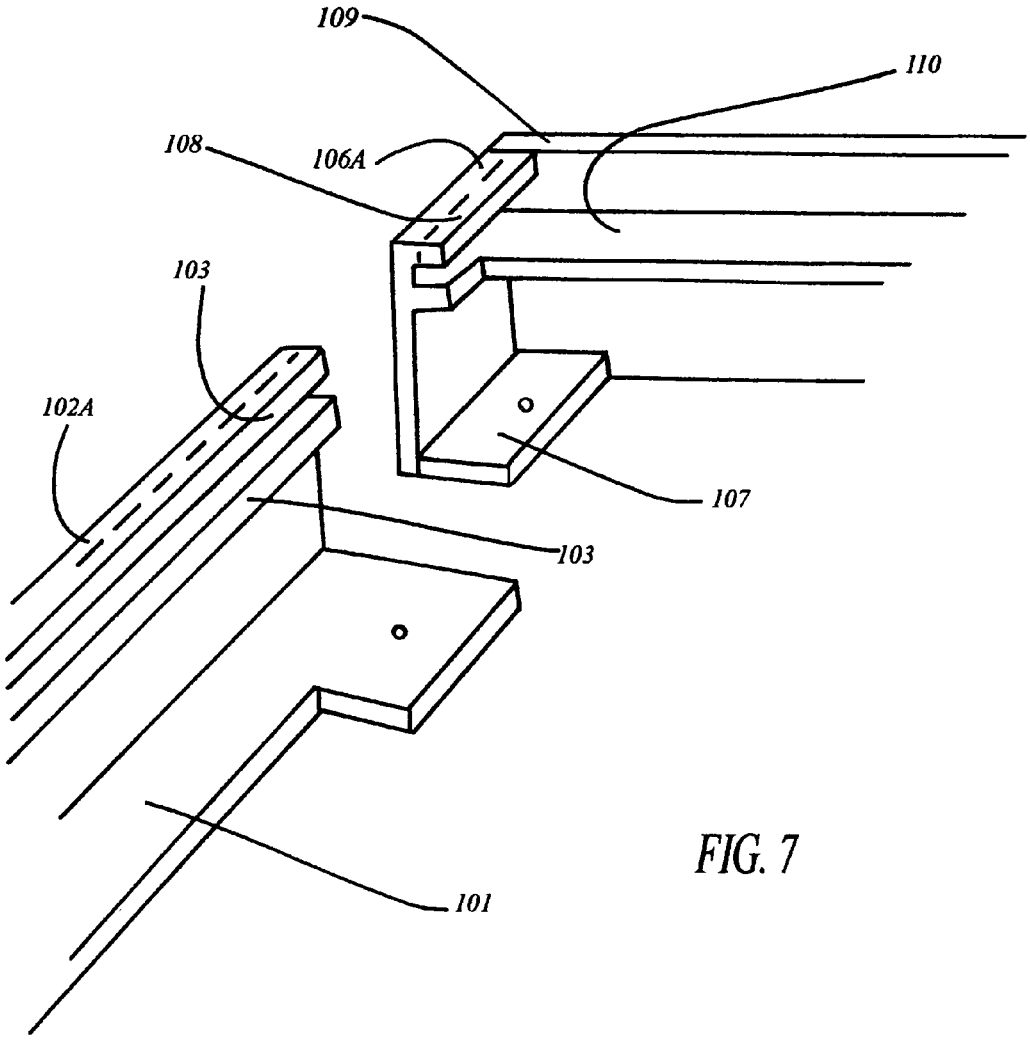
FIG. 6 is a magnified view of the left upper distal corner of the apparatus, the front panel, with the distal small panel is attached, the small base, is attached to the small distal panel, the small square rod is attached to the distal small panel's top edge, the brace with the square end, is attached to the front panel, the small base with a hole cut in for the screw.
FIG. 7 is a magnified view of the left distal upper end of the proximal panel, with 2 square rods attached to the upper edge of the panel, and the panel is attached to the base, there are holes cut in the base for screws.
Figures 8, 9:
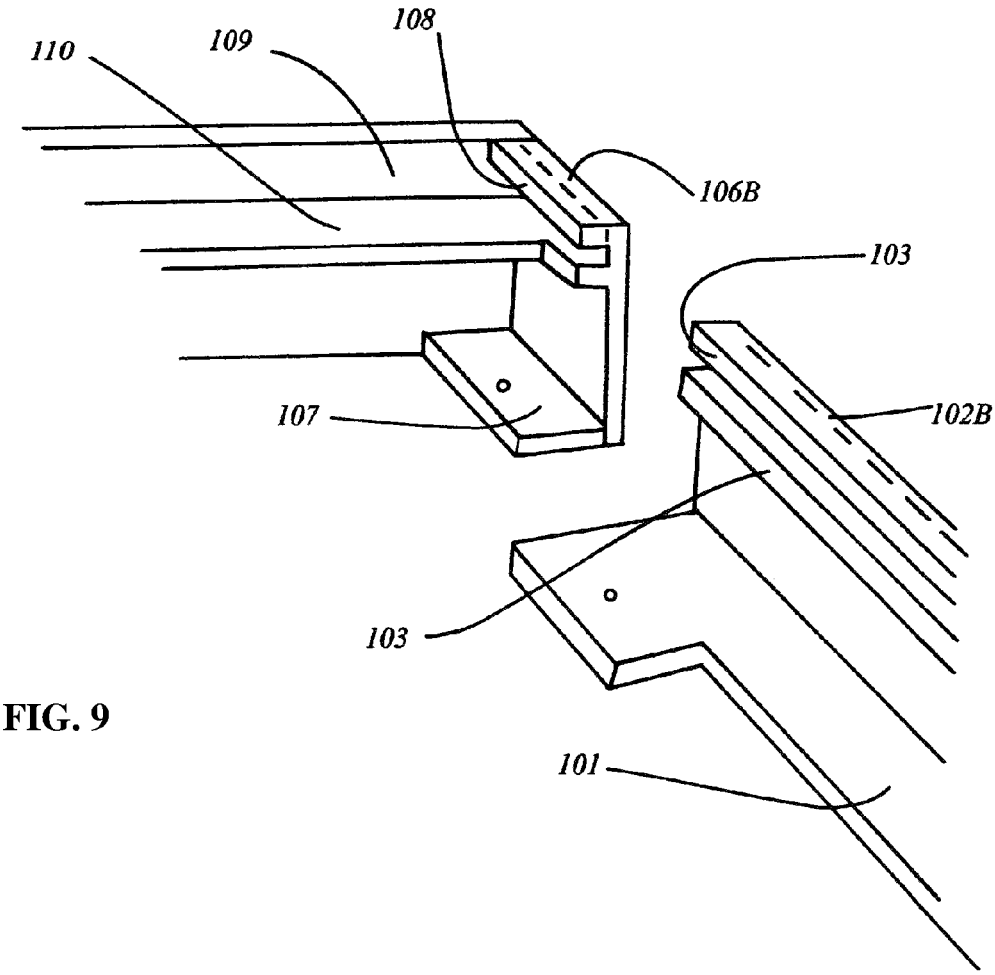
FIG. 8 is a magnified view of the right lower distal corner of the apparatus, the front panel, with the distal small panel are attached, the small base, is attached to the small distal panel, the small square rod is attached to the distal small panel's top edge, the brace with the square end, is attached to the front panel, the small base have a hole cut in for the screw.
FIG. 9 is a magnified view of the right lower distal end of the proximal panel, with 2 square rods attached to the upper part of the panel, and the panel is attached to the base, there are holes cut in the base for screws.
Figure 10:
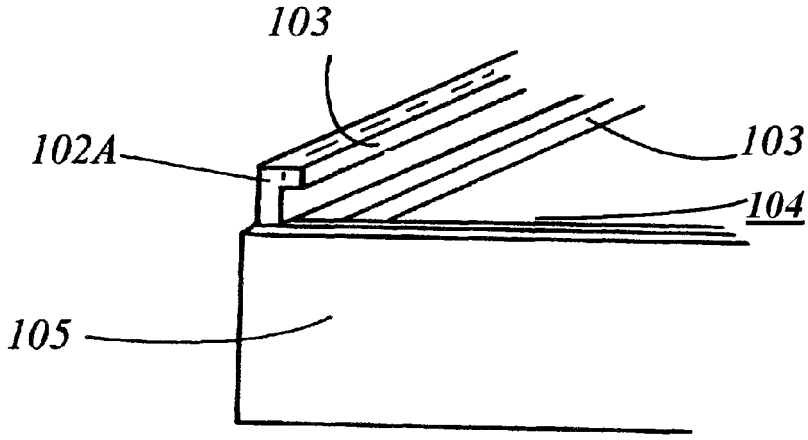
FIG. 10 is a magnified view of the left upper rear corner of the apparatus, the proximal panel have 2 square rods attached to the upper edge of the panel, the rear inside panel is attached to the proximal panel and the lower square rod, the rear out side panel, is attached to the back of the rear inside panel, and the end of the proximal panel.
Figure 11:
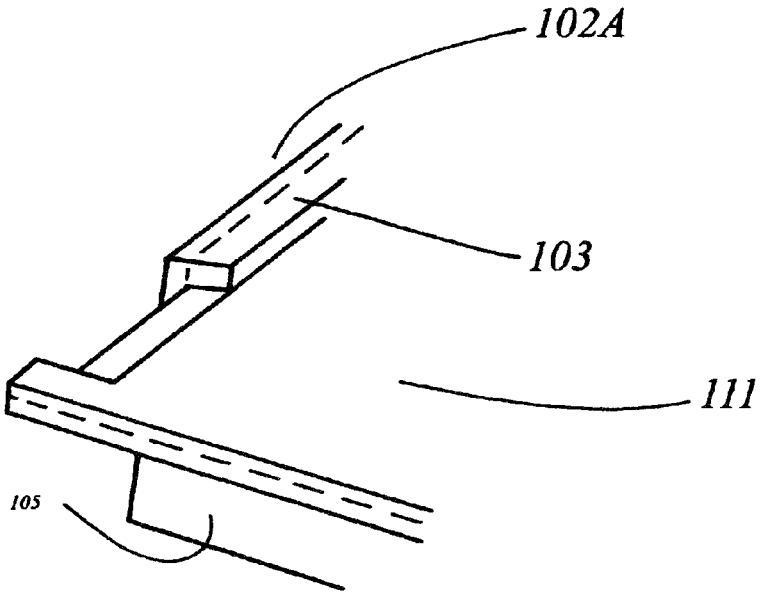
FIG. 11 is a magnified view of the left upper rear corner of the apparatus with the sliding door partially inserted in the rear opening and a partial view of the rear panel, the proximal panel, and the square rod is attached to the upper part of the proximal panel.
Figure 12:
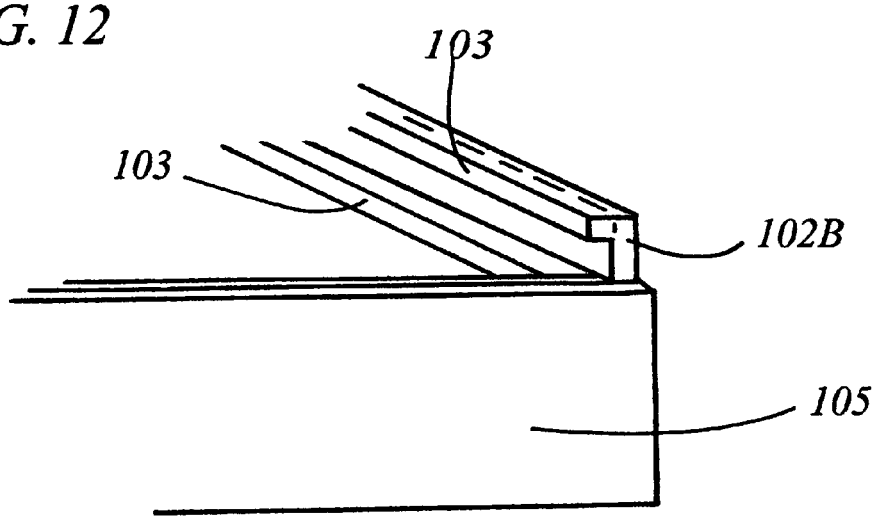
FIG. 12 is a magnified view of the right lower rear corner of the apparatus, the proximal panel with 2 square rods attached to the upper part of the panel, the rear inside panel is attached to the proximal panel and the lower square rod, the rear out side panel is attached to the back of the rear inside panel, and the end of the proximal.
Figure 13:
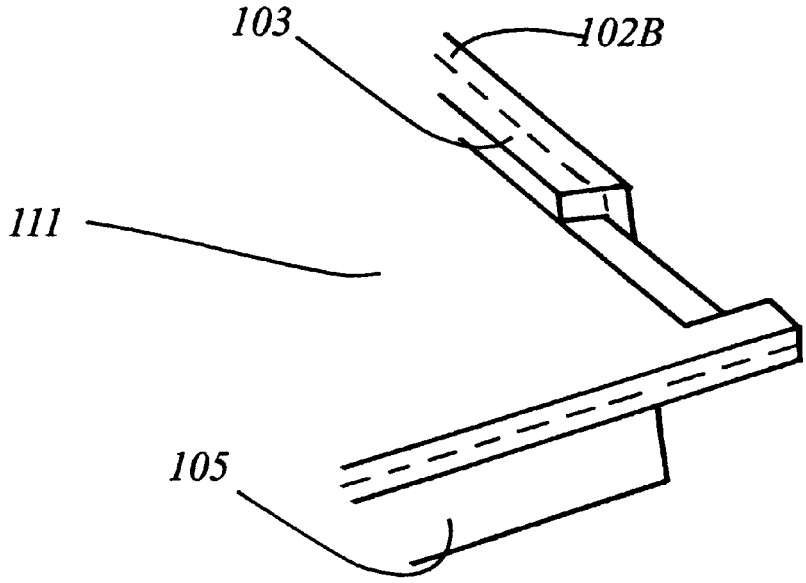
FIG. 13 is a magnified view, of the right lower rear corner of the apparatus, with the sliding door partially inserted in rear opening, and a partial view of the rear out side panel, the proximal panel, and the square rod, attached to the upper edge of the proximal panel.

The present invention is constructed from a sheet of acrylic cut into 19 pieces, to form a rectangular structure with a base, four sides sliding door to conceal the security devices, such as: door knobs, deadbolt locks, chain locks and surface locks, on the entrance door of an apartment or a house.

The 19 pieces of acrylic are ¼ of an inch thick, they include: 1 proximal base 101, 2 proximal panels 102A the upper panel and 102B the lower panel. There are 4 square rods 103, 2 for said upper panel and 2 for said lower panel. There are 2 rear panels 1 inner surface 104 and 1 outer surface 105. There are 2 small distal panels 1 upper 106A and 1 lower 106B. There are 2 small bases 107, 1 for said upper panel 106A and 1 for said lower panel 106B. There are 2 small square rods 108, 1 for said upper distal panel 106A and 1 for said lower distal panel 106B. There is 1 front panel 109, and 1 distal brace 110 for said front panel 109. The sliding door 111 has 2 parts 1 top side and 1 bottom side.

Other elements in view: 112 is the chain lock of the entrance door, 113 is the surface lock of said entrance door, 114 is the knob of the deadbolt lock of said entrance door, 115 is the door knob of said entrance door, 116 is the sliding door knob of said invention, 117 is the opening of said entrance door.

The base of said apparatus 101 is measured and cut to fit over the parameters of the security devices. Of the 4 square rods 103, 2 are cemented to the upper side of the proximal panel 102A. A gap of approximately ¼ of an inch separates the 2 square rods on each said proximal panels 102A and 102B. The position of said square rods 103 are designed to create tracks for the sliding door 111. Then said upper and lower panels 102A and 102B are cemented to the base 101. Said rear inner panel 104 is cemented to the back inner sides of said upper and lower panel 102A and 102B. The rear outer panel 105 is cemented to the ends of said upper and lower proximal panels 102A and 102B, and the back of said inner panel 104.

Of the 2 small square rods 108, 1 is cemented to said upper edge of said small distal upper panel 106A and 1 is cemented to the upper edge of said small distal lower panel 106B. Of the 2 small bases 107, 1 is cemented to the lower edges of said upper distal panel 106A and 1 is cemented to the lower edge of said lower distal panel 106B. The distal upper and lower panels 106A and 106B are cemented to the front of said panel 109. A long brace 110, cut with 2 small square shaped rods at each end of said brace, said brace is cemented to said front panel 109, and to said distal upper and lower panels 106A and 106B, said square rod ends of said brace 110 are cemented approximately ¼ inch below each said square rod 108. Said long brace 110 is designed to support said front panel 109, said square shaped rod ends of 110 are designed to create tracks at the distal end of said embodiment for the sliding door 111. Said sliding door 111 is made from a sheet of acrylic cut in 2 piece slabs. Said 2 piece slabs are cut to fit in the parameters of said 4 panels: said upper proximal 102A, said lower proximal panel 102B, said upper distal panel 106A and said lower distal panel 106B. The longitudinal ends of said sliding door's top slab 111 is cut ¼ of an inch shorter than said bottom slab to create a rail for said bottom slab of said sliding door 111. Said bottom slab, allows said door to slide into said tracks created by said square rods 103, 108, and said square rod shaped ends of said brace 110. There are 2 pieces cut from the middle of said bottom slab 111, it is to reduce the weight of said sliding door.

I claim:

1. In combination, a concealing structure mounted to a residential entrance door, the combination comprising:

the residential entrance door including an exterior surface having a chain lock, a deadbolt lock, a surface lock, and a door knob, the concealing structure comprising a substantially rectangular housing including a top, a bottom, two sides, and a rear such that the housing defines an open front, the rear of the housing fastened to the exterior surface of the residential entrance door, the top and bottom of the housing including respective grooves, wherein the housing encompasses the chain lock, the deadbolt lock, the surface lock, and the door knob such that the chain lock, the deadbolt lock, the surface lock, and the door knob are adapted to be exposed and accessible via the open front; and a sliding door cooperating with housing for opening and closing the front of the housing, the sliding door having an exterior front surface with a knob thereon, a top edge, a bottom edge and two side edges, the top and bottom edges of the sliding door including respective tongues which slidably mate with respective grooves in the top and the bottom of the housing, and wherein the sliding door slides between an open position such that the chain lock, the deadbolt lock, the surface lock, and the door knob are exposed and accessible, and a closed position such that the chain lock, the deadbolt lock, the surface lock, and the door knob are substantially enclosed and conceal from view.

* * * * *